US011795728B2

(12) United States Patent
Buchmüller

(10) Patent No.: US 11,795,728 B2
(45) Date of Patent: Oct. 24, 2023

(54) CYLINDER LOCK

(71) Applicant: ABUS August Bremicker Söhne KG, Wetter-Volmarstein (DE)

(72) Inventor: Eduard Buchmüller, Rehe (DE)

(73) Assignee: ABUS AUGUST BREMICKER SÖHNE KG, Wetter-Volmarstein (DE)

( * ) Notice: Subject to any disclaimer, the term of this patent is extended or adjusted under 35 U.S.C. 154(b) by 264 days.

(21) Appl. No.: 17/243,935

(22) Filed: Apr. 29, 2021

(65) Prior Publication Data

US 2021/0355708 A1 Nov. 18, 2021

(30) Foreign Application Priority Data

May 15, 2020 (DE) ..... 102020113197.6

(51) Int. Cl.
*E05B 9/08* (2006.01)
*E05B 27/00* (2006.01)

(52) U.S. Cl.
CPC ..... *E05B 9/086* (2013.01); *E05B 27/0053* (2013.01)

(58) Field of Classification Search
CPC ..... E05B 9/084; E05B 9/086; E05B 27/0053; E05B 35/08; E05B 35/10; E05B 35/14
See application file for complete search history.

(56) References Cited

U.S. PATENT DOCUMENTS 3,713,311 A 1/1973 Oliver et al.
4,282,731 A * 8/1981 Taksony ..... E05B 27/0064 70/419
5,431,034 A * 7/1995 Fann ..... E05B 9/086 70/369
5,884,512 A 3/1999 Wayne
5,964,110 A * 10/1999 Crocco ..... E05B 9/086 70/369
6,578,396 B2 * 6/2003 Field ..... E05B 9/084 70/369
6,718,807 B2 * 4/2004 Andersson ..... E05B 9/086 70/369
7,650,769 B2 * 1/2010 Lo ..... E05B 9/086 70/371

(Continued)

FOREIGN PATENT DOCUMENTS

DE 69111409 T2 3/1996
DE 102006061224 B3 1/2008

(Continued)

*Primary Examiner* — Christopher J Boswell
(74) *Attorney, Agent, or Firm* — Dickinson Wright PLLC

(57) ABSTRACT

A cylinder lock comprises a lock cylinder; a holder for receiving the lock cylinder; and a securing element, wherein the lock cylinder comprises a cylinder housing and a cylinder core that is rotatable about a cylinder axis in the cylinder housing and that has a keyway, wherein the securing element is axially fixedly held at the lock cylinder and has a blocking section, which contacts an abutment section of the holder in a blocking position, and a coupling section. The coupling section is accessible for a coupling actuation through the keyway and is rotationally fixedly couplable to the cylinder core by the coupling actuation. The blocking section is hereby then displaceable from the blocking position into a release position, in which the lock cylinder is released for a removal from the holder, by turning the cylinder core by means of an associated key.

18 Claims, 12 Drawing Sheets

(56) References Cited

U.S. PATENT DOCUMENTS

| | | | | |
|---|---|---|---|---|
| 8,336,348 | B2 * | 12/2012 | Dalton, Jr. | E05B 27/00 70/340 |
| 8,479,545 | B2 * | 7/2013 | Teixeira | E05B 27/0032 70/419 |
| 8,584,495 | B2 * | 11/2013 | Chiou | E05B 9/084 70/369 |
| 9,309,695 | B2 * | 4/2016 | Westwinkel | E05B 27/0053 |
| 10,273,717 | B2 * | 4/2019 | Clifford | E05B 27/005 |
| 11,306,505 | B2 * | 4/2022 | Lin | E05B 27/005 |
| 2005/0072197 | A1 | 4/2005 | Evans et al. | |

FOREIGN PATENT DOCUMENTS

| | | | |
|---|---|---|---|
| DE | 202012100370 | U1 | 5/2013 |
| EP | 0354877 | A2 | 2/1990 |

* cited by examiner

CYLINDER LOCK

CROSS-REFERENCES TO RELATED APPLICATIONS

This application claims the benefit and priority of German Application No. DE 102020113197.6 filed on May 15, 2020. The entire disclosure of the above application is incorporated herein by reference.

FIELD

The invention relates to a cylinder lock comprising a lock cylinder; and a holder for receiving the lock cylinder, wherein the lock cylinder has a cylinder housing and a cylinder core that is rotatable about a cylinder axis in the cylinder housing and that has a keyway.

BACKGROUND

Such cylinder locks have numerous application possibilities and may generally be used for stationary or mobile locking mechanisms such as doors, flaps or the like or in padlocks, bicycle locks or the like to be able to selectively block or open the respective locking mechanism or release it for an opening by operating the cylinder lock. For this purpose, an associated key may be introduced into the keyway of the cylinder core and the cylinder core may be rotationally moved about the cylinder axis between a blocked position and an open position by means of the key, wherein a turning of the cylinder core from the blocked position into the release position is blocked as long as the correct key is not introduced.

In the blocked position of the cylinder core, an opening actuation of the locking mechanism, for example for an opening movement of a door or a flap relative to an installation environment, may be blocked by a latch. Such a latch may be driven directly or indirectly (e.g. via a coupled lock bit) by the rotatable cylinder core, for example via an entrainer section provided at the rear side of the cylinder core. By transferring the cylinder core into the open position, such a latch may, for example, be retracted or released to be able to open the locking mechanism or the door, flap or the like.

Through the selective blocking or release of locking mechanisms of doors, flaps or the like by means of such cylinder locks, rooms or buildings may, for example, be protected against unauthorized access or objects stored in boxes or containers may be secured. The blocking and opening function of a lock cylinder may also be used indirectly, for example to block a door handle in the blocked position of the cylinder core and to release it for an actuation in the open position of the cylinder core. For example, handles that are foldable or pivotable from a plane of the door may thus be blocked or released. In this respect, after the unlocking of the cylinder lock a latch may, for example, be urged back by an actuation of the handle so that the door or flap may be opened.

To be able to reliably counteract break-open attempts, it is necessary that the cylinder lock is securely received in the respective installation environment (e.g. a door or flap). For this purpose, a holder may be provided that forms the installation environment or that is fixedly connected to the installation environment. The lock cylinder should be fixed in the associated holder such that an unauthorized removal is largely prevented. However, it may be desired in some cases to enable a removal of the lock cylinder from the holder by the authorized user, for example, to be able to replace the lock cylinder with another lock cylinder that is operable by means of a different key. In particular in the case of objects that are to be accessible to changing authorized users, for example in rented motor homes, other vehicles, rooms or buildings, it may be desired to replace the lock cylinder before handing over the object to a further person to be able to guarantee the security of the object. In some such cases, there is the problem here that the lock cylinder and the installation environment are only accessible from a front side, i.e. from that side to which the key introduction opening of the keyway leads.

SUMMARY

It is an object of the invention to provide a cylinder lock that enables a reliable fixing of the lock cylinder in the associated holder with respect to unauthorized removal attempts, on the one hand, and a simple and fast removal or change of the lock cylinder by the authorized user, on the other hand.

This object is satisfied by a cylinder lock having the features of claim 1 and in particular in that the cylinder lock has a securing element, wherein the securing element is axially fixedly held at the lock cylinder and has a blocking section that contacts an abutment section of the holder in a blocking position to secure the lock cylinder against a removal from the holder. The securing element further has a coupling section that is accessible through the keyway for a coupling actuation and that is rotationally fixedly couplable to the cylinder core by such a coupling actuation, wherein the blocking section of the securing element, by turning the cylinder core by means of an associated key when the coupling section of the securing element is rotationally fixedly coupled to the cylinder core, is displaceable from the blocking position into a release position in which the lock cylinder is released for a removal from the holder.

First, a secure and reliable fixing of the lock cylinder in the holder with respect to unauthorized removal attempts may be achieved by the securing element and the contact of its blocking section with the abutment section of the holder. The holder may in particular have a reception recess into which the lock cylinder may be inserted axially with respect to the cylinder axis or is inserted in the assembled state. Since the securing element is axially fixedly held at the lock cylinder and the blocking section of the securing element contacts the abutment section of the holder in the blocking position, an axial removal of the lock cylinder from the holder may be prevented. In this respect, the blocking section of the securing element may—with respect to a viewing direction along the cylinder axis—engage behind the abutment section of the holder in the blocking position such that the lock cylinder is secured against a removal from the holder by the securing element. The holder may in particular peripherally surround the lock cylinder so that a removal from the holder may generally take place solely in the axial direction and the lock cylinder may be completely secured in the holder by the blocking section of the securing element in its blocking position.

To enable the authorized user in a simple and fast manner, despite this reliable securing with respect to unauthorized removal attempts, to be able to selectively remove the lock cylinder from the holder and, for example, to replace it, the fixing of the lock cylinder in the holder may be canceled by the authorized user. For this purpose, the coupling section of the securing element may first be actuated in a first step by means of any desired tool passed through the keyway from the outside or by means of a key configured in a specific manner—as will be explained in the following—to couple the coupling section to the cylinder core in a rotationally fixed manner (i.e. fixed with respect to rotation). For example, an elongate bar-like tool may be used for this purpose and may be brought into contact with the coupling section through the keyway, wherein the keyway may serve to guide the tool. The coupling actuation may in this respect in particular take place by a force application on the coupling section, wherein a force may in particular be transmitted to the coupling section in the axial direction or along the cylinder axis by means of the tool or special key guided through the keyway. As a result of such a force application, the coupling section may, for example, be bent, deflected, and/or displaced to establish a connection (e.g. an engagement connection) with the cylinder core.

Once the coupling section of the securing element has been rotationally fixedly coupled to the cylinder core in this first step, it is necessary in a second step to turn the cylinder core by means of the associated key in order to move the blocking section into the release position and to enable a removal of the lock cylinder from the holder. Thus, no change in the position of the blocking section takes place solely due to a coupling actuation of the coupling section; instead, a turning of the cylinder core by means of the associated key is necessary for this purpose. The key used for the turning of the cylinder core may be the associated key used in the normal use of the cylinder lock or said special key used for the coupling actuation may also be used for the turning of the cylinder core. Due to the coupling to the coupling section of the securing element, the turning of the cylinder core causes a displacement of the blocking section of the securing element in the direction of the release position. For this purpose, the blocking section may be drive-effectively connected to the coupling section, for example, via a connection section of the securing element, as will be explained in the following. However, the turning of the cylinder core may only be carried out by the authorized user in possession of the associated key so that only the authorized user may move the blocking section into the release position in which a removal of the lock cylinder from the holder is possible. Manipulation attempts may, in contrast, be reliably prevented. In this respect, the blocking section may in particular be brought out of alignment with the abutment section of the holder by turning the cylinder core after a coupling actuation of the coupling section so that the blocking section does not block an axial movement of the lock cylinder out of the holder in the release position and the lock cylinder may be removed from the holder.

To achieve a high level of security of the cylinder lock and to enable a removal of the lock cylinder from the holder solely by the authorized user, the lock cylinder may, for example, have a plurality of tumblers (e.g. pin tumblers or plate tumblers) that block the cylinder core against a rotation relative to the cylinder housing in the blocked position, but that may be sorted by the introduction of the associated key into the keyway in order to release the cylinder core for a rotation. The cylinder core may only be transferred into the open position, in which, for example, a door secured by the cylinder lock may be opened, by an introduction of the key or with sorted tumblers. Similarly, when the coupling section is rotationally fixedly coupled to the cylinder core, the blocking section of the securing element may only be moved into the release position by means of the associated key, wherein provision may in particular be made for the cylinder core to be moved completely into the open position from the blocked position.

On the one hand, such a cylinder lock consequently enables a reliable fixing of the lock cylinder in the holder to counteract break-open attempts or manipulation attempts. On the other hand, the lock cylinder may, however, be removed and, for example, replaced in a simple manner by the authorized user by the two-step displacement of the blocking section of the securing element into the release position. Since the coupling actuation of the coupling section of the securing element takes place from the outside frontally through the keyway, a special key or another suitable tool may be guided or led through the keyway directly toward the coupling section. The coupling actuation of the coupling section may therefore be carried out without problem and in particular also without specific technical knowledge by a user who is not familiar in detail with the design of the cylinder lock. Thereupon, the cylinder core merely has to be turned in the usual way by means of the associated key to displace the blocking section into the release position and to be able to remove the lock cylinder from the holder.

Further embodiments can be seen from the dependent claims, from the description, and from the drawings.

In some embodiments, the coupling section of the securing element may be arranged in alignment with the keyway of the cylinder core. The coupling section of the securing element may in particular be arranged in alignment with the keyway when the cylinder core is in the blocked position and the cylinder lock is blocked. In this respect, the securing element may at least partly surround the cylinder core or the cylinder housing and the coupling section may extend inwardly in alignment with the keyway in a radial manner with respect to the cylinder axis. Due to the arrangement of the coupling section in alignment with the keyway, a tool guided through the keyway or a key specifically provided for this purpose may come into direct contact with the coupling section or may be led onto the coupling section in alignment with the keyway so that a coupling actuation of the coupling section of the securing element for a rotationally fixed coupling to the cylinder core may be carried out in a very uncomplicated manner.

In some embodiments, the coupling section of the securing element may be configured to be moved away from the keyway by the coupling actuation, particularly away from a key introduction opening of the cylinder core. Said coupling actuation may in particular be an axial pressure actuation or force application. The coupling section may in this respect in particular have a force directed away from the keyway applied to it by a tool guided through the keyway or by a special key in order to be moved away from the keyway and rotationally fixedly coupled to the cylinder core as a result of this force application. The keyway may in this respect extend along the cylinder axis so that the coupling section of the securing element may also be moved away from the keyway in an axial manner with respect to the cylinder axis by the coupling actuation. For example, the coupling section may be bent over or displaced by the coupling actuation to be rotationally fixedly coupled to the cylinder core. Provision may generally also be made that the coupling section of the securing element is configured to be moved toward the keyway by the coupling actuation.

In some embodiments, the coupling section of the securing element may be configured, due to the coupling actuation or force application taking place through the keyway, to be rotationally fixedly coupled to the cylinder core in a permanent or stable manner, in particular by an inelastic or bistable deformation. In other words, the coupling section may be configured to also maintain the rotationally fixed coupling to the cylinder core after the termination of the coupling actuation.

For example, the coupling section may be plastically deformable by the coupling actuation, wherein the deformed coupling section is in particular rotationally fixedly coupled to the cylinder core in a permanent manner. For example, the coupling section may in this respect be able to be urged away from the keyway by a tool guided through the keyway and may thereby be inelastically deformable so that the rotationally fixed coupling may remain also on a removal of the tool and an ending of a force application on the coupling section. Such a plastic deformation may, for example, take place by a bending of the coupling section, wherein provision may also be made that the coupling section may be set into a pivot movement by the coupling actuation through the keyway, with there being a rotationally fixed coupling to the cylinder core at the end point of said pivot movement. Alternatively to a plastic deformation, the coupling section may, for example, be configured as a bistable spring that snaps over after overcoming a certain resistance or a dead center due to the coupling actuation and is that is thus stably deformed, for example by a deflection angle that lies in a range from 30° to 90°. In such an embodiment, the coupling section may be rotationally fixedly coupled to the cylinder core after the snapping over. The snapping over may, for example, be haptically and/or acoustically detectable for the user so that the user may perceive the successful coupling actuation of the coupling section.

However, a permanent or inelastic deformation of the coupling section of the securing element is not absolutely necessary for the purpose of the rotationally fixed coupling to the cylinder core, in particular if a (longer) special key is used for the coupling actuation that holds the coupling section in engagement with the cylinder core up to and during the subsequent turning of the cylinder core.

In some embodiments, the cylinder core may have a coupling recess, wherein the coupling section of the securing element may be configured to be brought into a coupling engagement with the coupling recess of the cylinder core by the coupling actuation or force application taking place through the keyway. The coupling recess may in this respect in particular be arranged in alignment with the keyway so that the coupling section of the securing element may, for example, be urged or pushed into the coupling recess by the coupling actuation through the keyway. The coupling recess may in this respect face in the direction of the keyway or be axially opposite the keyway along the cylinder axis. The coupling section of the securing element may in particular be brought into a permanent coupling engagement with the coupling recess of the cylinder core by a force application and a stable deformation caused thereby, for example by a bending, so that the coupling section of the securing element may thereupon be rotationally fixedly coupled to the cylinder core in a permanent manner.

The coupling recess may, for example, be formed or arranged in a slot-like and/or eccentric manner with respect to the cylinder axis to enable the transmission of a torque. Prior to a coupling actuation, the coupling section of the securing element may be arranged axially with respect to the cylinder axis between the coupling recess and the keyway and/or may in particular extend in alignment with the keyway and the coupling recess in the blocked position of the cylinder core. The cylinder core may be formed in one part, whereas it is also possible for the cylinder core to comprise a plurality of elements which are rotationally fixedly connected to one another and of which one has the coupling recess.

In some embodiments, a first and a second associated key may be provided, wherein the first and the second associated key may be configured for a rotational actuation of the cylinder core, and wherein the second associated key—as the already mentioned special key—may be configured such that the coupling actuation is performable by means of the second associated key. The second associated key may in this respect in particular have an axial actuation prolongation by which the coupling section may be able to be urged away from the keyway when the second associated key is introduced into the keyway.

While the first associated key may be primarily provided to be able to turn the cylinder core for opening and closing a cylinder lock in normal use, the second associated key may in particular be specifically provided for a removal of the lock cylinder from the housing. In this respect, the second associated key may be configured to automatically perform the coupling actuation by or during an introduction into the keyway and to rotationally fixedly connect the coupling section to the cylinder core in order to move the blocking section into the release position by a subsequent turning of the cylinder core, in particular into the open position. For this purpose, both the first associated key and the second associated key may be configured to sort tumblers of the lock cylinder and thereby enable a turning of the cylinder core.

A removal of the lock cylinder by means of such a second associated key also generally takes place in two steps in that first the coupling actuation is performed by the introduction of the second associated key into the keyway and then the blocking section of the securing element is transferred into the release position by turning the cylinder core by means of the second associated key. However, a user only has to introduce the second associated key into the keyway and may thereupon immediately turn the cylinder core so that a separate introduction of another tool into the keyway to perform the coupling actuation and a subsequent removal of the tool to release the keyway for the introduction of the (first or second) associated key may be omitted.

In addition to different recesses formed along a key shaft to be able to sort tumblers of the lock cylinder and to enable a turning of the cylinder core, the second associated key may in particular have an actuation prolongation that may represent an axial extension of the second associated key with respect to the first associated key. The extent of the actuation prolongation may be such that the actuation prolongation comes into contact with the coupling section during an introduction of the second associated key into the keyway or before the second associated key is fully introduced into the keyway in order to apply a force directed away from the keyway to the coupling section. The coupling section may in particular be deformed by this coupling actuation and may, for example, be urged into a coupling recess. The actuation prolongation of the second associated key may in particular be arranged in such a coupling recess of the cylinder core during the rotary actuation of the cylinder core by means of the second associated key.

In some embodiments, provision may be made that the coupling section is elastically deformable by the coupling actuation performed by means of the second associated key. Thus, on the use of the second associated key, it is not necessary for the coupling section of the securing element to be permanently or inelastically deformable. In this respect, the second associated key may, for example, have an actuation prolongation by which the coupling section may be urged into a coupling recess for a rotationally fixed coupling to the cylinder core and may be deformed in the process. During the subsequent turning of the cylinder core to transfer the blocking section into the release position, the coupling section may be held in a rotationally fixed coupling to the cylinder core by the actuation prolongation, wherein the coupling section may again return to the position prior to the coupling actuation after a removal of the cylinder core from the holder and a withdrawal of the second associated key from the keyway.

In some embodiments, the cylinder core may have an entrainer section, wherein the coupling section of the securing element may be rotationally fixedly couplable to the entrainer section of the cylinder core. Such an entrainer section may in particular be provided to drive a lock element arranged downstream, for example, to enable or block the actuation of a handle of a door or flap in dependence on the position of the cylinder core. The entrainer section may be arranged at a rear side of the cylinder core, that is at an end of the cylinder core that is axially opposite, with respect to the cylinder axis, a key introduction opening for the introduction of the key into the keyway. To be able to couple the coupling section to the entrainer section, the entrainer section may in particular have the coupling recess already mentioned with which the coupling section of the securing element may be brought into a coupling engagement in the course of a coupling actuation and into which the coupling section may in particular be able to be urged by a force application.

The entrainer section of the cylinder core may in particular be formed by a separate entrainment element that is fixedly connected, in particular screwed, to the remainder of the cylinder core. Alternatively, it is, however, also possible for the cylinder core to be formed in one part and to have an integrated entrainer section for driving a lock element that is arranged downstream and that may in particular form a rear-side end section of the cylinder core.

The coupling section of the securing element may be arranged in a rotary cut-out of the cylinder core, in particular of the entrainer section or of an entrainment element. The rotary cutout may in this respect be formed as an axially narrow recess in which the coupling section is arranged axially with respect to the cylinder axis between the keyway and a coupling recess formed at the entrainer section. For opening or blocking the cylinder lock, the cylinder core and its entrainer section or an entrainment element connected to the remaining part of the cylinder core may thereby be freely rotatable relative to the coupling section of the securing element provided that the coupling section has not been previously rotationally fixedly coupled to the cylinder core by the coupling actuation. During the use of the cylinder lock for the opening or blocking, the blocking section of the securing element may consequently reliably remain in the blocking position without the securing element moving in the meantime.

The coupling section and the blocking section of the securing element may in particular be arranged in a common plane prior to the coupling actuation taking place through the keyway. This common plane may extend orthogonally to the cylinder axis.

In some embodiments, the securing element may have a ring and/or a ring section. A ring may in this respect form a peripherally closed structure, while a ring section may be peripherally open and may, for example, be C-shaped. In this respect, the ring or the ring section may, for example, be hollow cylindrical (with a pronounced lateral surface, i.e. with an axial extent along the cylinder axis that is larger than the material thickness of the ring or ring section), or disk-shaped, or flat (for instance in the manner of a circlip, i.e. with an axial extent along the cylinder axis that is smaller than the ring width of the ring or ring section). Such a ring or ring section may in particular form a connection section of the securing element which at least partly engages around a section of the cylinder housing and from which the coupling section of the securing element may extend radially inwardly with respect to the cylinder axis so that, in the blocked position of the cylinder core, the coupling section may, for example, be arranged in alignment with the keyway and may be comfortably reachable through the keyway for the coupling actuation. The blocking section may project laterally away from such a ring or ring section to engage behind the abutment section of the holder and thereby to secure the lock cylinder in the holder.

The securing element may be formed in one part or multiple parts, in particular also in multiple layers.

In some embodiments, the securing element may be axially fixedly held in a ring groove of the lock cylinder. Such a ring groove may in this respect in particular be arranged at a side of the lock cylinder that is axially opposite the key introduction opening, through which the key may be introduced into the keyway, with respect to the cylinder axis. The ring groove may, for example, be formed by an end section of the cylinder housing that has a smaller extent in the radial direction with respect to the cylinder axis than a section of the cylinder housing that is an adjoining section in the direction of the key introduction opening. At a rear side, the ring groove may further, for example, be bounded by the entrainer section, in particular an entrainment element, that may likewise have a larger radial extent than said end section of the cylinder housing. The securing element may thus be axially fixed between the entrainer section and the section of the cylinder housing extending further outwardly in a radial manner. A ring-shaped or ring section-shaped connection section of the securing element may in this respect in particular be arranged in the ring groove from which the coupling section and/or the blocking section projects/project.

In some embodiments, the blocking section of the securing element may be movable relative to the cylinder housing and/or relative to the holder. In the blocking position, the blocking section may in this respect in particular be arranged out of alignment with the lock cylinder with respect to the cylinder axis (viewed along the cylinder axis) and may project laterally to be able to contact the abutment section and fix the lock cylinder in the holder. After the coupling actuation of the coupling section, the blocking section may be movable in the radial direction and/or in the tangential direction with respect to the cylinder axis by turning the cylinder core so that the blocking section may in particular be arranged in alignment with the lock cylinder in the release position to be able to remove the lock cylinder from the holder.

In some embodiments, the blocking section of the securing element may be preloaded in the direction of the blocking position. Such a preload may, for example, be generated by an inherent elasticity of the blocking section and/or of the securing element and/or by a separate spring. The securing element may also comprise a spring or be formed as a spring. By turning the cylinder core by means of the associated key, the blocking section may be moved against the preload into the release position after a coupling actuation of the coupling section, while the preload may reliably hold the blocking section in the blocking position during the use of the cylinder lock.

In some embodiments, in the relaxed state, the securing element may have a peripheral oversize with respect to the lock cylinder and in particular with respect to said ring groove of the lock cylinder so that, on the turning of the cylinder core by means of the associated key and on the corresponding movement of the blocking section, the blocking section has a sufficient clearance to be able to move into the release position.

In some embodiments, the blocking section may be configured to directly follow the rotational movement of the coupling section during the turning of the cylinder core coupled to the coupling section. In other embodiments, an indirect drive of the blocking section may be provided, for example, due to a sliding along of the blocking section at a guide section of the cylinder housing or of the holder.

The securing element may have a support section with which the securing element is supported against a rotation relative to the cylinder housing and/or to the holder. A preload of the blocking section in the direction of the blocking position may in particular be generated by means of such a support section and an unintentional, for example friction-induced, co-rotation of the securing element on a movement of the cylinder core for opening or blocking the cylinder lock may be prevented. After a coupling actuation of the coupling section, the securing element or a spring may, in contrast, be tensioned against the preload by turning the cylinder core in order to be able to move the blocking section radially and/or tangentially with respect to the cylinder axis relative to the holder and/or to the cylinder housing into the release position.

The support section may in particular project outwardly away from a connection section of the securing element in a plane orthogonal to the cylinder axis and/or laterally, in particular radially or obliquely to a radial orientation, and contact an inner side of the holder in order to support itself against a rotation relative to the holder. Alternatively to a contact with the holder, the support section may also be formed at the cylinder housing and/or connected to the cylinder housing.

In some embodiments, the securing element may have an arcuate connection section. The arcuate connection section may in this respect in particular at least partly surround the cylinder housing. For example, the cylinder housing may have a substantially hollow cylindrical core reception section into which the cylinder core is inserted and the arcuate connection section may at least partly surround the core reception section of the cylinder housing. The coupling section may, for example, extend radially inwardly with respect to the cylinder axis, starting from the connection section.

The arcuate connection section may be elastic, in particular within a plane orthogonal to the cylinder axis. In some embodiments, the blocking section of the securing element may project laterally, in particular radially, outwardly with respect to the arcuate shape of the connection section. In this respect, the elasticity of the coupling section may generate a preload of the blocking section into the blocking position, wherein the blocking section may be movable against the preload relative to the cylinder housing and/or to the holder into the release position after a coupling actuation of the coupling section. For this purpose, the coupling section may be elastically deformable during the turning of the cylinder core when the coupling section is rotationally fixedly coupled to the cylinder core. The arcuate connection section may be substantially rigid in some embodiments, wherein the connection section may be preloaded by a separate spring.

The arcuate connection section may in particular extend between the support section and the blocking section of the securing element. The connection section may in this respect in particular have the shape of a ring section and may be interrupted between the blocking section and the support section of the securing element, i.e. the blocking section and the support section may be arranged at ends of the securing element at both sides.

In some embodiments, the holder may have a lateral blocking recess into which the blocking section of the securing element projects or engages. The blocking section may in particular project through such a lateral blocking recess. The lateral blocking recess or its boundaries may form the abutment section for the blocking section so that the blocking section may contact the holder by the projection into or through the blocking recess and may thereby fix the lock cylinder in the holder.

The lock cylinder may extend along the cylinder axis in some embodiments. The cylinder housing may comprise a core reception section for receiving the cylinder core; and a flange section projecting away from the core reception section in a radial manner with respect to the cylinder axis, wherein the holder may comprise a holder core reception section and a holder flange section. The core reception section of the cylinder housing may in this respect in particular be substantially hollow cylindrical and the flange section projecting radially away from the core reception section may serve to receive pin tumblers for blocking the cylinder core in the blocked position. The lock cylinder may furthermore be rotationally fixedly held in the holder by the flange section.

A rear-side end section of the core reception section may extend axially with respect to the cylinder axis beyond the flange section, wherein the securing element or a connection section of the securing element may be arranged at the rear-side end section. The rear-side section of the core reception section may in particular have a reduced radial extent than the remaining part of the core reception section and may form the already mentioned ring groove.

The holder core reception section may further have a lower blocking recess through which the blocking section of the securing element may extend in the direction of the holder flange section. This lower blocking recess may merge into the lateral blocking recess into which the blocking section may project or through which the blocking section may project. The lateral blocking recess of the holder may in particular be formed at the holder flange section so that the holder flange section may form the abutment section for the blocking section of the securing element.

A contact surface for the above-mentioned support section of the securing element, with which the securing element may be supported with respect to rotations, may be formed at the holder flange section in a manner disposed opposite the lateral blocking recess. The lateral blocking recess may be open in the direction of a rear side of the holder. The lock cylinder or the cylinder housing may furthermore be axially fixed at the rear side by the holder flange section so that the holder flange section may form an abutment for the flange section of the cylinder housing. In the release position, the blocking section of the securing element may in particular be arranged in alignment with the flange section of the cylinder housing to enable a removal of the lock cylinder from the holder.

The securing element may in particular be produced from spring steel at least in part, in particular with the exception of the coupling section.

In some embodiments, the cylinder lock, as already explained, may have a first associated key and a second associated key that are both configured to turn the cylinder core. In this respect, the length of the first key may be selected such that the coupling section of the securing element is not actuable through a complete introduction of the first key into the keyway, wherein the length of the second associated key may be selected such that the coupling section of the securing element is actuable through a complete introduction of the second associated key into the keyway in order to rotationally fixedly couple the coupling section to the cylinder core.

While the first associated key may in particular serve to block or to open the cylinder lock during a normal use by turning the cylinder core, the second associated key may be specifically provided for removing the lock cylinder. For this purpose, the second associated key may come into contact with the coupling section during an introduction into the keyway to apply a force to the coupling section and thereby to actuate it. The user may thereupon turn the cylinder core and may thereby directly transfer the blocking section into the release position. However, in this respect, a removal of the lock cylinder from the holder is also only possible by the authorized user in that the tumblers of the lock cylinder are sorted by the introduction of a special key, in particular the second associated key. Only then is it possible to turn the cylinder core and to move the blocking section into the release position.

The invention further relates to a securing element for axially fixing a lock cylinder extending along a cylinder axis in a holder, said securing element comprising an arcuate connection section for axially fixedly connecting the securing element to the lock cylinder; a blocking section for blocking a relative axial movement between the lock cylinder and the holder, said blocking section projecting away laterally outwardly with respect to the arcuate shape of the connection section; and a coupling section projecting radially inwardly from the connection section.

The lock cylinder to be fixed may in this respect in particular comprise a cylinder housing having a substantially hollow cylindrical core reception section for receiving the cylinder core; and a flange section projecting away from the core reception section in a radial manner with respect to the cylinder axis. The arcuate connection section of the securing element may be formed as a closed ring or a ring section, for example as a C shape. The coupling section may project radially inwardly with respect to the circular arc or to the cylinder axis.

Due to such a securing element, on the one hand, the lock cylinder may, as described above, be secured in a simple manner in the holder with respect to unauthorized removal attempts and, on the other hand, a simple removal or change of the lock cylinder by the authorized user may be made possible.

In some embodiments, the coupling section may be stably deformable in the axial direction with respect to the cylinder axis, in particular by an inelastic or a bistable deformation. Such an axial deformability with respect to the cylinder axis may in particular enable a rotationally fixed coupling of the coupling section to a cylinder core. This may in particular be achieved by bending, snapping over, or pivoting the coupling section as a result of an axial force application.

Furthermore, the securing element may have a support section projecting outwardly away from the connection section substantially perpendicular to the cylinder axis. This support section may in this respect in particular project away from the connection section radially with respect to the cylinder axis or obliquely with respect to a radial orientation.

The securing element or its connection section may be at least partly elastically deformable, in particular within a plane orthogonal to the cylinder axis. Furthermore, the securing element may be produced from spring steel at least in part, in particular with the exception of the coupling section. This may in particular enable an extremely low-cost production of the securing element so that the securing element may be replaced without problem after a removal of the lock cylinder or after a coupling actuation of the coupling section. Alternatively to an elastic deformability of the securing element, the blocking section of the securing element may be preloaded in the direction of the blocking position by a separate spring.

Furthermore, the securing element may have the features already mentioned in connection with the cylinder lock.

The invention further relates to a method of removing a lock cylinder of a cylinder lock from a holder, wherein the lock cylinder has a cylinder housing and a cylinder core that is rotatable about a cylinder axis in the cylinder housing and that has a keyway, wherein the lock cylinder is received in the holder and is secured against a removal from the holder by a securing element axially fixedly held at the lock cylinder, wherein the securing element has a blocking section that contacts an abutment section of the holder in a blocking position. The cylinder lock may in particular be configured as disclosed herein. In this method, a coupling section of the securing element is rotationally fixedly coupled to the cylinder core by a coupling actuation through the keyway, then the cylinder core is turned by means of an associated key and the blocking section is hereby transferred into a release position. Further, the cylinder core is removed from the holder.

The coupling actuation of the coupling section may in this respect in particular take place by means of any desired tool, in particular an elongate or bar-like tool, through the keyway in order to exert a force away from the keyway onto the coupling section. The blocking section may thereupon be moved into a release position by the turning of the cylinder core, wherein the blocking section may in particular be set into alignment with a flange section of the cylinder housing. However, this may only take place by the authorized user since the cylinder core may only be turned by the associated key. The lock cylinder may thereupon be removed, in particular axially removed, from the holder. Consequently, the method enables the authorized user to easily and quickly remove the lock cylinder from the holder, whereas a removal of the lock cylinder from the holder by an unauthorized user may be effectively prevented.

Provision may in particular also be made that the coupling actuation may be performed by means of the or a further associated key so that no separate tool is required for the coupling actuation. The associated key may in this respect in particular be configured as a second associated key that is specifically provided for the removal of the lock cylinder from the holder. In addition thereto, a first associated key may be provided by means of which the cylinder core may indeed be rotationally moved to open or block the cylinder lock, but no coupling actuation may be performed. For this purpose, the second associated key may, for example, have an actuation prolongation in order to come into contact with the coupling section as a result of an introduction into the keyway and exert a force onto the coupling section. This may make it possible to remove the lock cylinder from the holder in two steps, but only while using the associated key, in particular the second associated key.

Provision may be made that, after the removal of the lock cylinder, a further lock cylinder is inserted into the holder that has a cylinder core that is rotationally actuable by means of a further key, but not by means of the key associated with the removed lock cylinder. Provision may consequently be made that the lock cylinder is replaced so that the cylinder lock may thereupon be opened by means of a different key. In particular with objects that are secured by the cylinder lock and that may be temporarily opened in an authorized manner by different users, for example during a rental period, the security for each of the users may thereby be ensured.

DRAWINGS

The invention will be described in the following purely by way of example with reference to an embodiment and to the drawings.

There are shown:

Figure 5A:
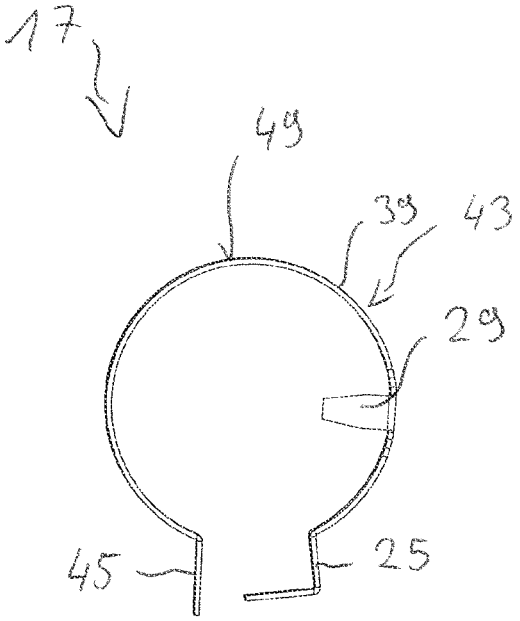
Figure 5B:
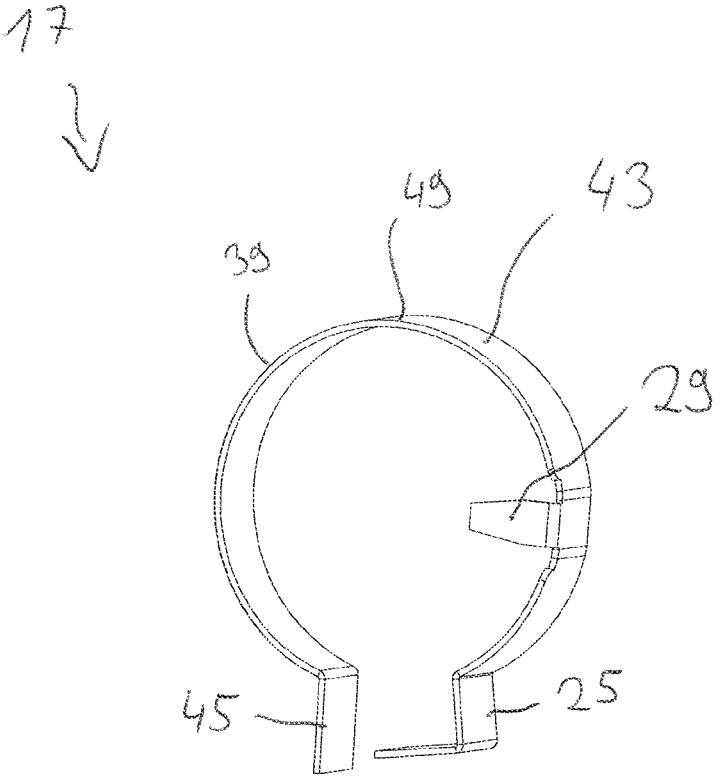
Figure 6:
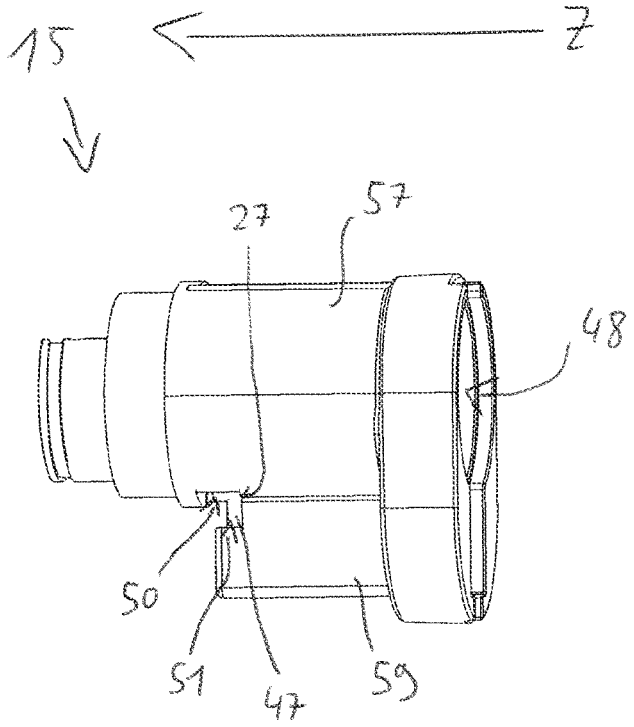
Figure 7:
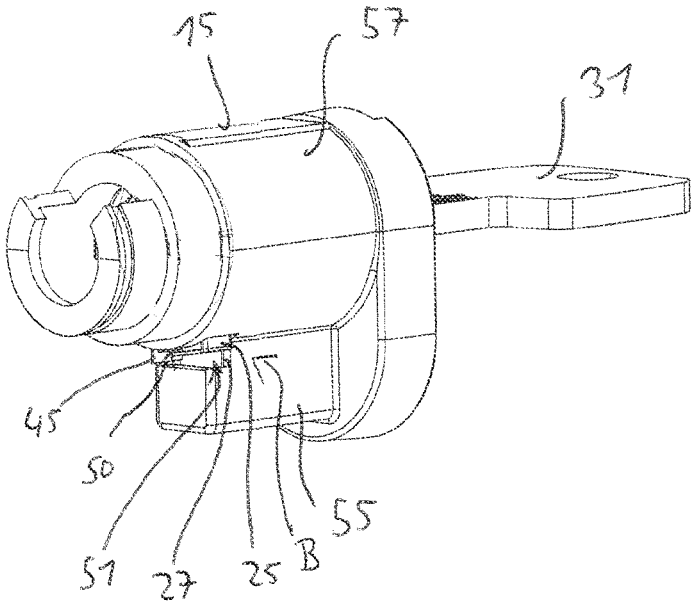
Figure 8A:
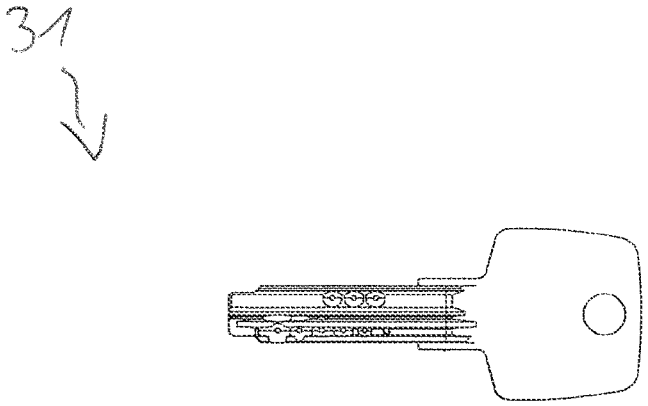
Figure 8B:
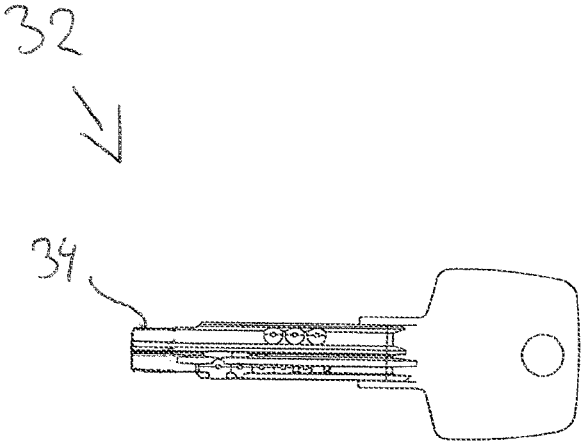

FIGS. 5A and 5B include a rear view of a securing element for securing the lock cylinder in the holder, and a perspective view of components of the securing element;

FIG. 6 is a perspective side view of the holder;

FIG. 7 is a perspective rear view of the holder with the lock cylinder inserted; and FIGS. 8A and 8B are respective side views of a first associated key and a second associated key.

DESCRIPTION

Figure 1:
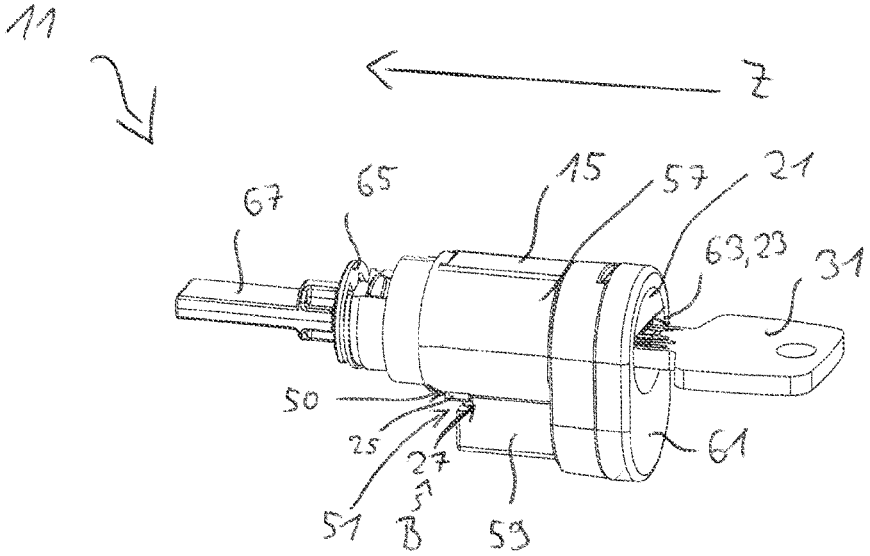
FIG. 1 is a perspective representation of a cylinder lock with a lock cylinder received in a holder.

FIG. 1 shows a cylinder lock 11 that extends along a cylinder axis Z and that may be operated by means of a key 31 introduced through a key introduction opening 63 into a keyway 23 in order to turn a cylinder core 21 between a blocked position and an open position. The cylinder core 21 is in this respect inserted as part of a lock cylinder 13 (cf. FIGS. 2A to 4C) into a holder 15 that may, for example, be fixed in a door, in a flap or in another installation environment of a locking mechanism to be able to lock the door, the flap or the like by means of the cylinder lock 11 or to be able to release it for an opening. For this purpose, a lock insert 67 secured by means of a securing ring 65 extends out of the holder 15 at a side of the holder 15 axially opposite the key introduction opening 63 with respect to the cylinder axis Z, said lock insert 67 being rotationally fixedly coupled to the cylinder core 21 and, for example, being able to be provided to enable or to block an actuation of a locking mechanism, such as of a handle of a door or of a flap, in dependence on the rotational position of the cylinder core 21.

Figure 2A:
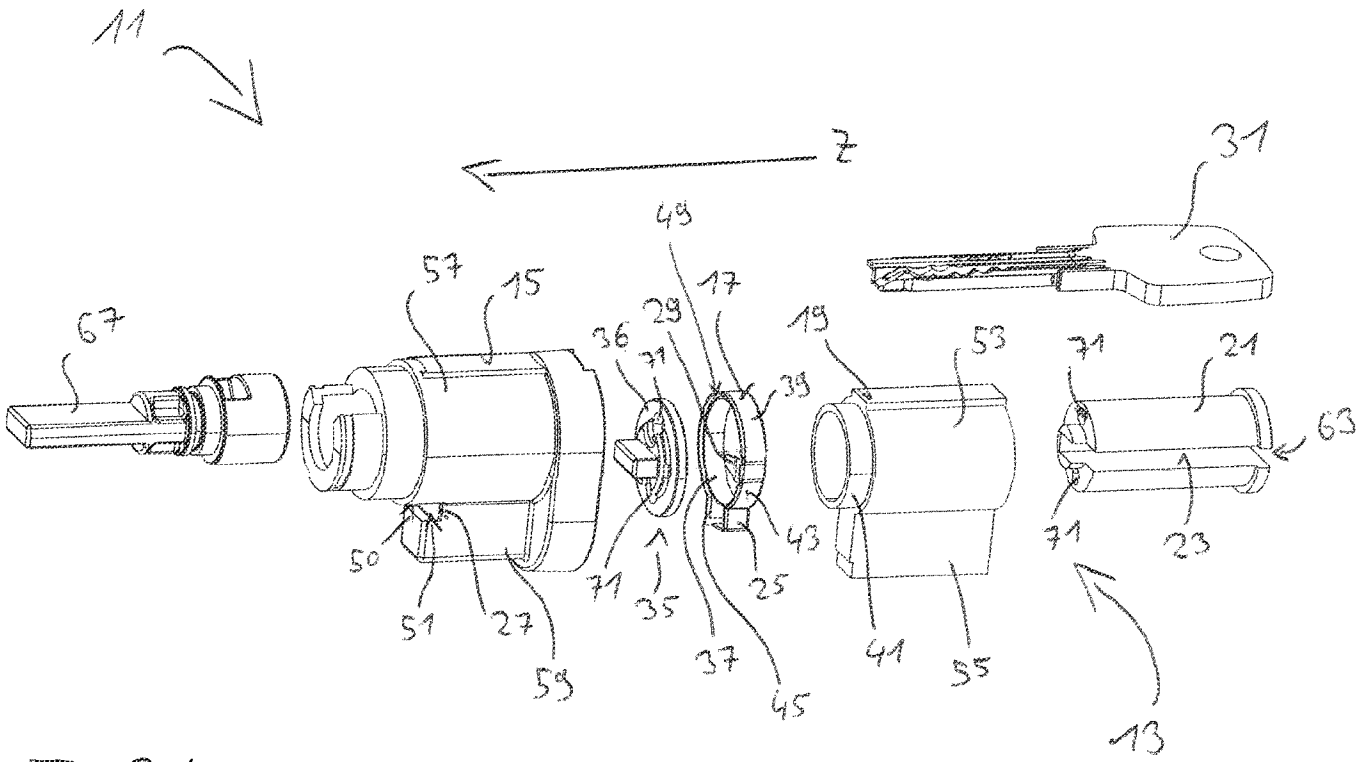
FIGS. 2A and 2B are rear-side and front-side perspective exploded representations of essential components of the cylinder lock.
Figure 2B:
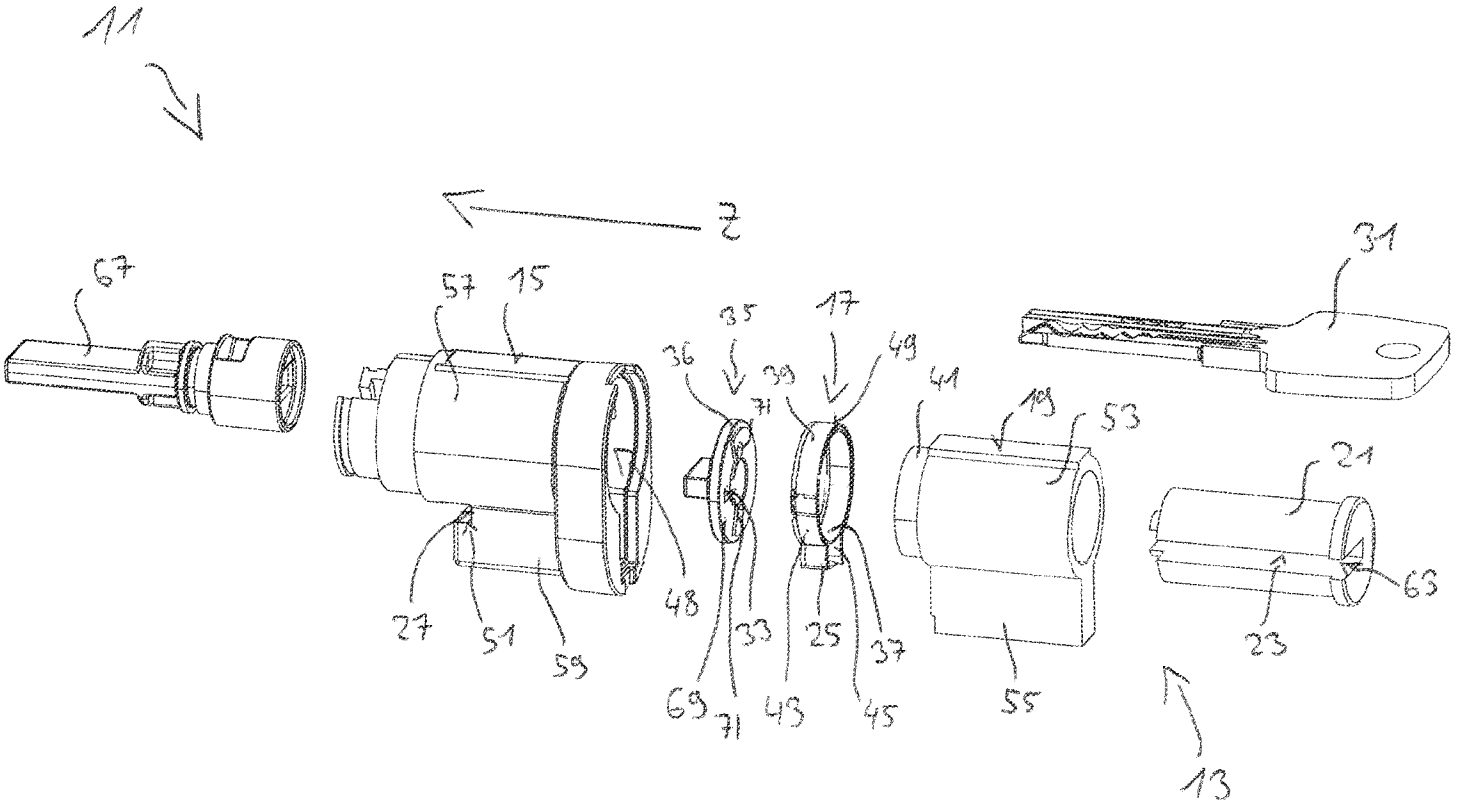

As the exploded representations of FIGS. 2A and 2B illustrate, the lock cylinder 13 may be inserted through a reception opening 48 into the holder 15 in an axial manner with respect to the cylinder axis Z. The lock cylinder 13 has a cylinder housing 19 in which a cylinder core 21 is received rotatably about a cylinder axis B. In this respect, the cylinder housing 19 comprises a substantially hollow cylindrical core reception section 53 for receiving the cylinder core 21; and a flange section 55 projecting away from the core reception section 53 in a radial manner with respect to the cylinder axis Z. Furthermore, the lock cylinder 13 may have tumblers, not shown, that block a rotation about the cylinder axis Z in a blocked position of the cylinder core 21, but that may be sorted by an introduction of the key 31 into the keyway 23 such that a turning of the cylinder core 21 into an open position may take place. An opening of the cylinder lock 11 is therefore only possible by means of the associated key 31.

The holder 15 is configured to peripherally surround the lock cylinder 13 or the cylinder housing 17 and, in the exemplary embodiment shown here, has a holder core reception section 57 and a holder flange section 59 in a manner reflecting the shape of the cylinder housing 19. In this respect, the lock cylinder 13 may be rotationally fixedly held in the holder 15 by the flange section 55 projecting radially away from the core reception section 53 and by the holder flange section 57. Furthermore, the holder 15 has a cap 61 that is shown in FIG. 1 and that covers the cylinder housing 19 in the direction of the key introduction opening 63. It must be noted that the holder 15 may generally have any desired shape and may in particular also form part of a larger installation environment of the lock cylinder 13.

Since the holder 15 peripherally surrounds the lock cylinder 13, the latter may at most be axially removed from the holder 15 through the reception opening 48. Consequently, it is necessary to fix the lock cylinder 13 axially in the holder in order to secure the lock cylinder 13 against unauthorized removal attempts. For this purpose, a securing element 17 is provided that is axially fixedly held at the lock cylinder 13 or at the cylinder housing 19. This securing element 17 in this respect has an arcuate connection section 49 that is formed by a ring section 39 and that is connectable to the cylinder housing 19 at a ring groove 41. As shown in FIGS. 2A and 2B, the securing element 17 may optionally have an additional stabilizing element 37. In this respect, the ring groove 41 is formed by an end section of the core reception section 53 that is at the rear side or that is axially opposite the key introduction opening 63 with respect to the cylinder axis Z and that extends beyond the flange section 55 and has an extent in the radial direction that is reduced with respect to the remaining part of the core reception section 53.

Figure 3:
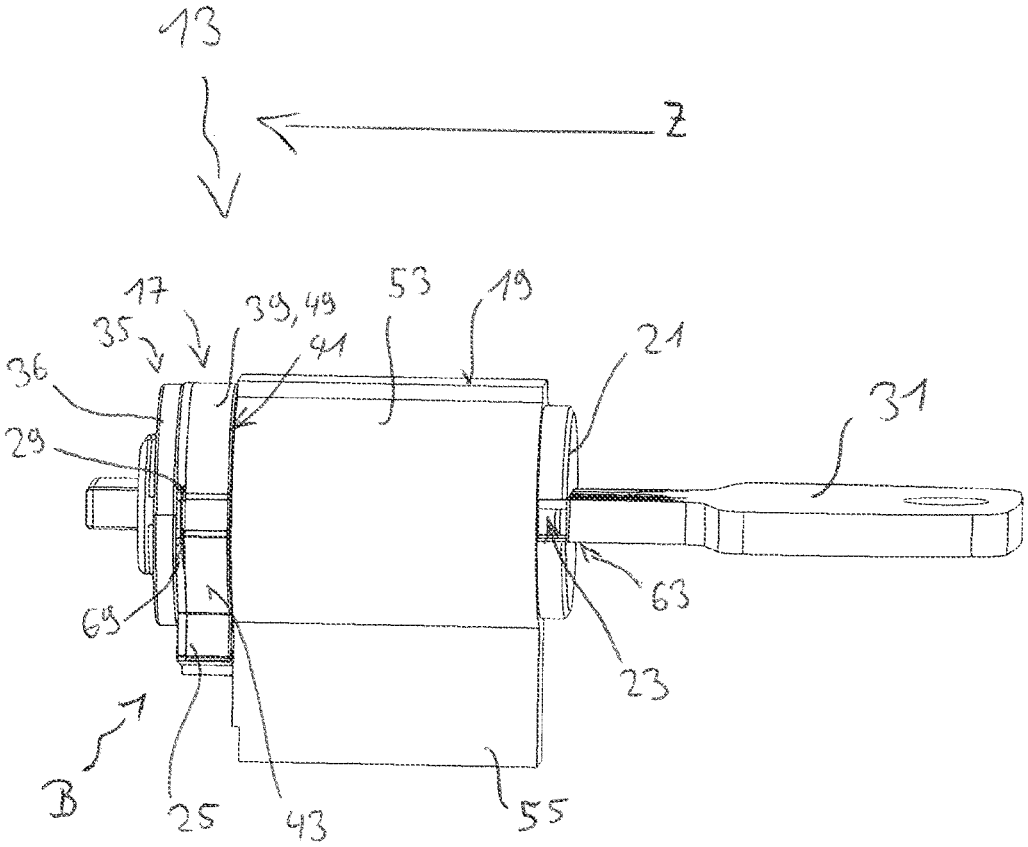
FIG. 3 is a side view of the lock cylinder of the cylinder lock.

Furthermore, at a rear side axially opposite the key introduction opening 63, the cylinder core 21 has an entrainer section 35 that is formed by an entrainment element 36 that is formed separately from the remainder of the cylinder core 21 and that is rotationally fixedly connected to the remaining part of the cylinder core 21 in the assembled state of the cylinder lock 11 (cf. in particular also FIG. 3). In this respect, the entrainment element 36, on the one hand, forms a rear-side boundary of the ring groove 41 to axially fixedly hold the securing element 17 and, on the other hand, serves to transmit a turning of the cylinder core 21 to the lock insert 67. The cylinder core 21 and the entrainment element 36 have mutually corresponding fastening openings 71 to be able to fixedly screw the entrainment element 36 and the cylinder core 21 to one another.

Figure 4A:
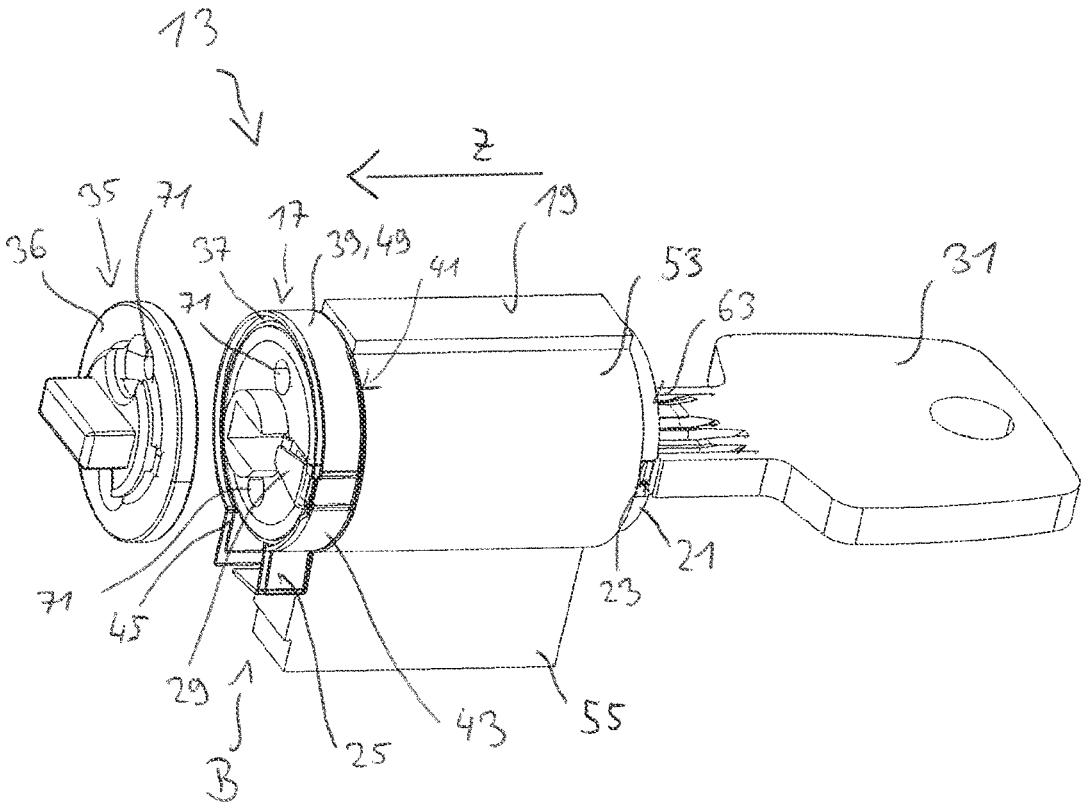
FIGS. 4A to 4C are a perspective rear view, a perspective front view, and a rear view of the lock cylinder with the entrainer section released or removed.
Figure 4B:
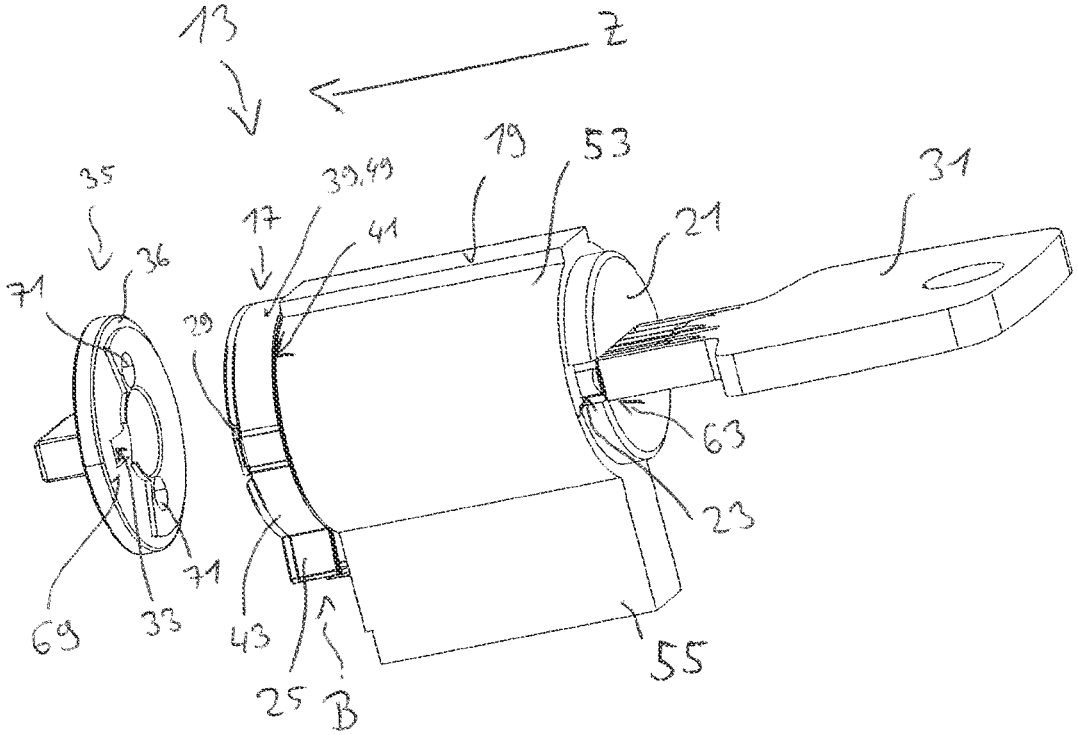
Figure 4C:
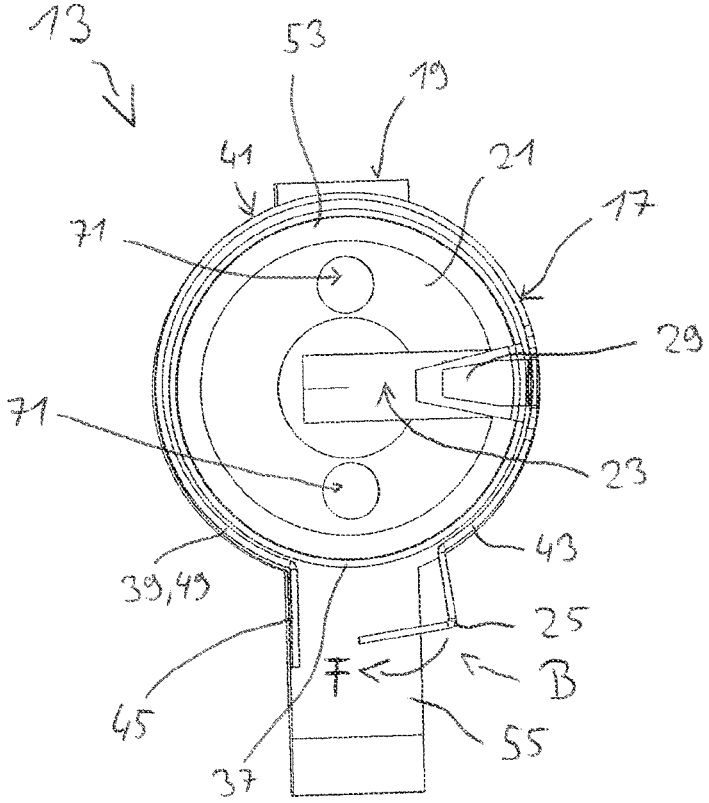

The securing element 17 has a blocking section 25 that projects laterally from the connection section 49, the blocking section 25 projecting laterally beyond the flange section 35 of the cylinder housing 19 in a blocking position B shown in the Figures and contacting an abutment section 27 formed by the holder 15 (cf. in particular FIGS. 1 and 7 and FIG. 4C). For this purpose, the holder core reception section 57 has a lower blocking recess 50 through which the blocking section 25 of the securing element 17 projects in the direction of the holder flange section 59 and into a lateral fastening recess 51 formed at the holder flange section 59. In this respect, the boundary of this lateral fastening recess 51 formed by the holder flange section 59 forms the abutment section 27 which the blocking section 25 contacts in an axially effective manner. Since the securing element 17 is axially fixedly held in the ring groove 41 at the lock cylinder 13 and engages behind the abutment section 27 in the explained manner, the lock cylinder 13 may be secured in the holder 15 in a reliable manner and in particular with respect to unauthorized removal or break-open attempts.

It may thus be achieved by the securing element 17 or its blocking section 25 that the lock cylinder 13 received in the holder 15 is reliably secured against an unauthorized removal. However, to enable the authorized user to remove the lock cylinder 13 from the holder 15 and, for example, to replace it with another lock cylinder that is actuable by means of another key, the securing element 17 has a coupling section 29 that projects radially inwardly from the connection section 49 (cf. in particular FIGS. 2A, 4A, 4C and 5A and 5B).

This coupling section 29 is in this respect arranged in alignment with the keyway 23 in the blocked position of the lock cylinder 13 or of its cylinder core 21 shown in the Figures and is actuable from the outside through the keyway 23 to establish a coupling engagement with the cylinder core 21 (cf. FIGS. 4A and 4C). Due to such a coupling actuation of the coupling section 29, the coupling section 29 of the securing element 17 may be rotationally fixedly connected to the cylinder core 21, whereupon the blocking section 25 may be able to be brought into a release position F by turning the cylinder core 21 by means of the associated key 31, said release position F being illustrated in FIG. 4C by an arrow that indicates the movement of the blocking section 25 to reach the release position F. This movement of the blocking section 25 extends approximately tangentially with respect to the cylinder axis Z. In the release position F of the blocking section 25, the lock cylinder 13 is released for a removal from the holder 15, wherein the blocking section 25 is moved out of the axial alignment of the abutment section 27 of the holder 15 (cf. FIGS. 2A and 7) and may in particular be arranged in alignment with the flange section 55 of the cylinder housing 19.

Due to this two-step transfer of the blocking section 25 into the release position F, a removal of the lock cylinder 13 from the holder 15 may solely take place by the authorized user since the associated key 31 is necessary in the second step to be able to turn the cylinder core 21. While the authorized user may thus cancel the securing of the lock cylinder 13 in the holder 15 from the outside and by means of two steps to be performed in an extremely simple and fast manner, the lock cylinder 13 is reliably secured by the securing element 17 with respect to unauthorized removal attempts.

To rotationally fixedly connect the coupling section 29 to the cylinder core 21, a coupling actuation may take place by means of an elongate tool, not shown, that is guidable through the keyway 23. In this respect, the coupling section 29 may be moved away from the keyway 23 by the tool or may be acted on by a force directed away from the keyway 23 and may thereby be stably deformed, whereby the coupling section 29 may be urged into a coupling recess 33 (cf. FIGS. 2B and 4B) formed at the entrainment element 36 and may be brought into a coupling engagement with the coupling recess 33. As a result of such a coupling actuation or force application on the coupling section 29, the coupling section 29 may be permanently deformed and may accordingly be permanently brought into a rotationally fixed coupling to the entrainment element 36 or the cylinder core 21. For example, the coupling section 29 may be inelastically bent by means of a tool guided through the keyway 23 or may snap over after overcoming a resistance in order to enter into a stable engagement, i.e. an independently maintained engagement, with the coupling recess 33.

As FIG. 4C in particular illustrates, a tool guided through the keyway 23 may be directly led onto the coupling section 29 and brought into contact with the coupling section 29 since the coupling section 39 is arranged in alignment with the keyway 23 in the blocked position of the cylinder core 21. A coupling actuation of the coupling section 29 may thus take place in a simple manner and without any knowledge of the design of the cylinder lock 11 so that users unfamiliar with this design may also easily perform the steps for removing the lock cylinder 13 from the holder 15.

Alternatively to a coupling actuation by means of a bar-like tool and a subsequent turning of the cylinder core 21 by means of the associated key 31, a second associated key 32 may also be provided that may be provided specifically for a removal of the lock cylinder 13 from the holder 15. As FIG. 8B shows, the second associated key 32 has an actuation prolongation 34 in comparison with the first associated key 31, illustrated again in FIG. 8A, so that the second associated key 32 is axially formed with a larger length than the first associated key 31. However, both the first associated key 31 and the second associated key 32 are configured to sort tumblers (e.g. pin tumblers) of the lock cylinder 13 to be able to turn the cylinder core 21.

The length of the second associated key 32 is selected by the actuation prolongation 34 such that the coupling section 29 may be actuated by introducing the second associated key 32 into the keyway 23 in order to rotationally fixedly couple the coupling section 29 to the cylinder core 21. Through an introduction of the second associated key 32, a force directed away from the keyway 23 may be transmitted to the coupling section 29 via the actuation prolongation 34 such that the coupling section 29 may be urged into the coupling recess 33. The blocking section 25 may then be moved directly into the release position F by turning the second associated key 32 introduced into the keyway 23. The actuation prolongation 34 may be arranged in the coupling recess 33 during a turning of the cylinder core 21.

In contrast, the first associated key 31 has a length that is selected such that the coupling section 29 is not actuable by the first associated key 31. While the second associated key 32 may therefore be specifically provided for the comfortable removal of the lock cylinder 13 from the holder 15, the first associated key 31 may serve for opening or blocking the cylinder lock 11 without a coupling of the coupling section 29 to the cylinder core 21 taking place during such a use of the cylinder lock 11.

However, to prevent an unwanted co-rotation of the coupling section 29 or of the securing element 17 prior to a coupling actuation of the coupling section 29 in the course of opening or blocking processes of the cylinder lock 11, the non-deformed coupling section 29 is arranged in a rotary cut-out 69 of the entrainment element 36 (cf. FIGS. 2B and 4B). The coupling section 29 may thereby extend radially inwardly between the keyway 23 and the entrainer section 35 from the connection section 49, wherein the cylinder core 21 and the entrainment element 36 may be rotated relative to the coupling section 29, and thus relative to the securing element 17, to operate the cylinder lock 11.

Furthermore, the securing element 17 has a support section 45 which projects laterally outwardly away from the connection section 49 perpendicular to the cylinder axis Z and with which the securing element 17 is supported with respect to a rotation relative to the cylinder housing 19 or the holder 15 (cf. FIGS. 5A and 5B). For this purpose, as is in particular visible from FIG. 6, the support section 45 contacts an inner side 51 of the holder flange section 59 that is arranged disposed opposite the lateral blocking recess 51 through which the blocking section 25 projects in the blocking position B.

In addition to the prevention of a co-rotation of the blocking element 17, the support section 45 also serves as an abutment to preload the blocking section 25 in the direction of the blocking position B. For this purpose, the securing element 17 is configured as a spring 43 and the connection section 49 may be placed onto the ring groove 41 of the cylinder housing 19 in a manner slightly outwardly preloaded in diameter. The connection section 49 may in particular be elastic for this purpose. During an assembly or for the insertion of the lock cylinder 13 into the holder 15, the securing element 17 may first be pressed together against the preload, wherein the blocking section 25 and the support section 45 may contact the inner walls of the holder 15 during the introduction of the lock cylinder 13 into the holder and may thereby keep the spring 43 under tension. The spring 43 may expand on a complete introduction of the lock cylinder 13, wherein the blocking section 25 projects through the lateral blocking recess 51, while the support section 45 holds the securing part 17 at the inner side 47 of the holder 15 opposite the blocking recess 51.

If the coupling section 29 is thereupon coupled to the cylinder core 21 and is taken along on a turning of the cylinder core 21, the expanded spring 43 may be inwardly tensioned again against the preload so that the blocking section 25 may be transferred into the release position F. In this respect, the connection section 49 may be arranged with clearance with respect to the ring groove 41 when the blocking section 25 is arranged in the blocking position B to enable a tensioning of the spring 43 during a movement of the blocking section 25 into the release position F. The blocking section 25 may thereby be arranged in alignment with the flange section 55 in the release position F to be able to remove the lock cylinder 13 from the holder 15. The blocking section 25 may in particular contact the support section 45 in the release position F.

The cylinder lock 11 explained by way of example here thus enables a secure and reliable fixing of the lock cylinder 13 in the holder 15 by means of the blocking section 25 of the securing element 17 to be able to counteract break-open attempts by a removal of the lock cylinder 13 from the holder 15. At the same time, the authorized user may, however, in a simple and fast manner selectively remove the lock cylinder 13 from the holder 15 and, for example, replace it. For example, after a removal of the lock cylinder 13, the user may insert a further lock cylinder into the holder 15 that may be actuable by means of another key 31, but not by means of the key 31 associated with the lock cylinder 21 originally present in the holder 15. The security of objects made accessible to changing users may in particular be increased by such a simple replacement of the lock cylinder 13 to be performed in a fast manner.

The invention claimed is:

1. A cylinder lock, comprising a lock cylinder; a holder for receiving the lock cylinder; and a securing element, wherein the lock cylinder has a cylinder housing and a cylinder core that is rotatable about a cylinder axis in the cylinder housing and that has a keyway;

wherein the securing element is axially fixedly held at the lock cylinder and has a blocking section that, in a blocking position, contacts an abutment section of the holder to secure the lock cylinder against a removal from the holder;

wherein the securing element further has a coupling section that is accessible through the keyway for a coupling actuation and that is rotationally fixedly couplable to the cylinder core by the coupling actuation; and wherein the blocking section of the securing element is displaceable from the blocking position into a release position, in which the lock cylinder is released for a removal from the holder, by turning the cylinder core by means of an associated key when the coupling section of the securing element is rotationally fixedly coupled to the cylinder core;

wherein the coupling section of the securing element moves away from the keyway, in an axial direction with respect to the cylinder axis, by the coupling actuation.

2. A cylinder lock in accordance with claim 1, wherein the coupling section of the securing element is arranged in alignment with the keyway of the cylinder core.

3. A cylinder lock in accordance with claim 1, wherein the coupling section of the securing element is configured to be rotationally fixedly coupled to the cylinder core in a stable manner due to the coupling actuation.

4. A cylinder lock in accordance with claim 1, wherein the coupling section of the securing element is configured to be rotationally fixedly coupled to the cylinder core by an inelastic or bistable deformation of the coupling section due to the coupling actuation.

5. A cylinder lock in accordance with claim 1, wherein the cylinder core has a coupling recess, wherein the coupling section of the securing element is configured to be brought into a coupling engagement with the coupling recess of the cylinder core by the coupling actuation.

6. A cylinder lock in accordance with claim 1, wherein the cylinder core has an entrainer section, wherein the coupling section of the securing element is rotationally fixedly couplable to the entrainer section of the cylinder core.

7. A cylinder lock in accordance with claim 1, wherein the securing element is formed as a ring or a ring section.

8. A cylinder lock in accordance with claim 1, wherein the securing element is axially fixedly held in a ring groove of the lock cylinder.

9. A cylinder lock in accordance with claim 1, wherein the blocking section of the securing element is movable relative to at least one of the cylinder housing or the holder.

10. A cylinder lock in accordance with claim 1, wherein the blocking section of the securing element is preloaded in the direction of the blocking position.

11. A cylinder lock in accordance with claim 1, wherein the securing element has a support section with which the securing element is supported against a rotation relative to at least one of the cylinder housing or the holder.

12. A cylinder lock in accordance with claim 1, wherein the securing element has an arcuate connection section, wherein the arcuate connection section at least partly surrounds the cylinder housing, and wherein the arcuate connection section is elastic.

13. A cylinder lock in accordance with claim 12, wherein the blocking section of the securing element projects laterally outwardly with respect to the arcuate shape of the connection section; and wherein the coupling section of the securing element projects radially inwardly from the arcuate connection section.

14. A cylinder lock in accordance with claim 1, wherein the holder has a lateral blocking recess into which the blocking section of the securing element projects.

15. A cylinder lock in accordance with claim 1, comprising a first associated key and a second associated key that are both configured to turn the cylinder core, wherein the length of the first key is selected such that the coupling section of the securing element is not actuable through a complete introduction of the first key into the keyway; and wherein the length of the second associated key is selected such that the coupling section of the securing element is actuable through a complete introduction of the second associated key into the keyway in order to rotationally fixedly couple the coupling section to the cylinder core.

16. A securing element for axially fixing a lock cylinder extending along a cylinder axis in a holder, said securing element comprising:

an arcuate connection section for axially fixedly connecting the securing element to the lock cylinder;

a blocking section for blocking a relative axial movement between the lock cylinder and the holder, said blocking section projecting away laterally outwardly with respect to the arcuate shape of the connection section; and a coupling section projecting radially inwardly from the connection section;

wherein the coupling section is configured to be deformed in the axial direction with respect to the cylinder axis in an inelastic or a bistable manner.

17. A securing element in accordance with claim 16, wherein the securing element has a support section projecting outwardly away from the connection section substantially perpendicular to the cylinder axis.

18. A method of removing a lock cylinder of a cylinder lock from a holder, wherein the lock cylinder has a cylinder housing and a cylinder core that is rotatable about a cylinder axis in the cylinder housing and that has a keyway, wherein the lock cylinder is received in the holder and is secured against a removal from the holder by a securing element axially fixedly held at the lock cylinder, and wherein the securing element has a blocking section that, in a blocking position, contacts an abutment section of the holder, the method comprising the steps of:

coupling a coupling section of the securing element in a rotationally fixedly manner to the cylinder core by a coupling actuation through the keyway;

thereafter turning the cylinder core by means of an associated key and bringing the blocking section into a release position through the turning of the key; and removing the cylinder core from the holder;

wherein the coupling section is moved axially with respect to the cylinder axis by the coupling actuation.

* * * * *